US006242402B1

(12) United States Patent
Robbins et al.

(10) Patent No.: US 6,242,402 B1
(45) **Date of Patent: *Jun. 5, 2001**

(54) SHOWER RINSING COMPOSITION

(75) Inventors: Michael H. Robbins; David Peterson, both of Pleasanton; Clement K. Choy, Alamo; Jana W. Chu, Alameda; James R. Latham, Livermore, all of CA (US)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/689,543

(22) Filed: Oct. 11, 2000

Related U.S. Application Data

(62) Division of application No. 09/096,628, filed on Jun. 12, 1998, now Pat. No. 6,659,916.

(51) Int. Cl.[7] ..... C11D 1/66; C11D 1/86; C11D 3/30; C11D 3/43

(52) U.S. Cl. ..... 510/238; 510/191; 510/199; 510/433; 510/434; 510/435; 510/470; 510/499; 510/533

(58) Field of Search ..... 510/191, 199, 510/238, 433, 434, 435, 470, 499, 533; 134/42

(56) References Cited

U.S. PATENT DOCUMENTS

| | | | | |
|---|---|---|---|---|
| 5,266,690 | * | 11/1993 | McCurry et al. | 510/119 |
| 5,424,010 | * | 6/1995 | Duliba et al. | 510/419 |
| 5,536,452 | | 7/1996 | Black | 510/238 |
| 5,587,022 | | 12/1996 | Black | 134/26 |
| 5,616,548 | * | 4/1997 | Thomas et al. | 510/242 |
| 5,798,329 | * | 8/1998 | Taylor et al. | 510/384 |
| 5,814,590 | * | 9/1998 | Sherry et al. | 510/237 |
| 5,814,591 | * | 9/1998 | Mills et al. | 510/238 |
| 5,948,741 | * | 9/1999 | Ochomogo et al. | 510/191 |
| 5,948,742 | * | 9/1999 | Chang et al. | 510/191 |
| 6,159,916 | * | 12/2000 | Robbins et al. | 510/238 |

FOREIGN PATENT DOCUMENTS

| | | |
|---|---|---|
| 10-8090 | 1/1998 | (JP) . |
| WO 98/02511 | 1/1998 | (WO) . |

* cited by examiner

*Primary Examiner*—Gregory Delcotto
(74) *Attorney, Agent, or Firm*—Joel J. Hayashida

(57) ABSTRACT

An improved cleaning composition is provided for shower and tub surfaces which is of the "shower rinsing" type, requiring no scrubbing, wiping, or immediate rinsing. The composition comprises: (a) a glycoside surfactant, the total amount of said surfactant being present in a cleaning effective amount; (b) a chelating agent, said chelating agent present in an amount effective to enhance bathroom soil removal in said composition; and (c) the remainder, water. A solvent such as isopropyl alcohol may also be added. The employment of a glycoside surfactant, especially one having an HLB value of greater than 13, remarkably improves the performance of such a shower rinsing composition both with respect to surface appearance streaking and filming and also bathroom soil and soap scum removing ability.

4 Claims, No Drawings

SHOWER RINSING COMPOSITION

This is a division of application Ser. No. 09/096,628, filed Jun. 12, 1998, entitled "SHOWER RINSING COMPOSITION" U.S. Pat. No. 6,159,916.

FIELD OF THE INVENTION

The present invention relates generally- to hard surface cleaners, and more particularly to an improved cleaning composition for tub and shower surfaces of the type which does not require scrubbing or wiping.

BACKGROUND OF THE INVENTION

Bathroom soils can be especially tenacious and difficult to remove. In particular, soils found on tub and shower surfaces are typically comprised in large part of insoluble calcium and magnesium salts of fatty acids (i.e., the products from reaction of the calcium and magnesium ions found in hard water with the various soaps used for bathing), together with smaller amounts of mineral deposits, dirt, oil, grease, fatty substances from the body (e.g., sebum), and chemical residues from hair grooming products and the like. This "soap scum" is quite unsightly and can be unhealthy as well, affording a breeding ground for mold, mildew, fungus, and bacteria.

A number of hard surface cleaners have been specially formulated to target bathroom soils. These cleaners may include such constituents as surfactants, chelants or sequestrants for assisting with the removal of soaps and mineral deposits, buffers, agents for combating mildew and fungus (e.g., liquid sodium hypochlorite), bacteriostats, dyes, fragrances, and the like in order to provide performance and/or aesthetic enhancements. In general, hard surface cleaners are applied by pouring, by application with a cloth or sponge, or by spraying in either an aerosol or non-aerosol fashion.

After application to tub and shower surfaces, most conventional cleaners require that the user expend a great deal of energy in removing the bathroom soil by scrubbing and wiping with the aid of a sponge or brush. The composition of these cleaners may be harsh to human skin, or at least somewhat irritating to sensitive skin, thereby additionally presenting the inconvenience that protective gloves be donned for the scrubbing and wiping.

Recently a new type of cleaner for tub and shower surfaces has become available to the consumer, the use of which requires neither scrubbing nor wiping. Rather, the cleaning composition is applied to those surfaces by spraying or rinsing after (preferably) each showering in what might be considered to be a "preventive maintenance" mode of operation. The dissolution and freeing of any formed soil is caused to occur in an efficient manner such that with each subsequent showering, the freed soil may be washed down the drain without the need for scrubbing or wiping or the like. The shower is kept in a continuously clean state. This new type of cleaner may be denoted a "shower rinsing" composition or cleaner.

It will be apparent that, upon application of such a shower rinsing composition, ideally there would be no apparent streaking, filming or residue to spoil the surface appearance. If such were otherwise, some wiping might be necessary to restore the appearance of a clean surface, and this would defeat, at least in some measure, a primary purpose of the product. It is highly desirable, then, that a shower rinsing cleaner yield an exceptionally clean-looking surface merely by spraying.

Disclosed in U.S. Pat. No. 5,536,452, issued to Black, is a method for using a shower rinsing composition. The composition comprises a nonionic surfactant variously described as having an hydrophilic-lipophilic balance ("HLB") value of either "13 or less" or "13.0 or less," an alcohol, and a chelating agent. The composition has a pH of 4–8. The preferred nonionic surfactant is stated to be ANTAROX BL-225, a linear mixed ethylene glycol ether, which has an HLB of 12. Other nonionic surfactants which are specifically called-out in the patent include alkylphenol glycol ethers, sorbitan oleic ester, and silicone polyalkoxylate block copolymers. (U.S. Pat. No. 5,536,452, also issued to Black, is essentially a more narrowly claimed version of the preceding Black method patent.)

Black explicitly teaches that nonionic surfactants having an HLB of greater than 13 are unsatisfactory in the compositions of his patents (e.g., in the exemplary formulations of Table I of each of the patents, a nonionic surfactant having an HLB of 13 is described as only "marginally satisfactory," while other nonionic surfactants having an HLB of 14 and higher are graded as "unsatisfactory"). Black fails to teach, disclose or suggest that a shower rinsing composition might utilize a glycoside as the nonionic surfactant. Indeed, Black teaches entirely away from this class of surfactant, as will be discussed below.

The compositions of the two Black patents are disadvantageous in at least two respects. For one, use of the suggested nonionic surfactants results in compositions that are cloudy at only slightly above room temperature. They therefore yield a product that is really only aesthetically presentable to the consumer when contained in an opaque bottle, whereas, modernly, it is desirable to be able to display a liquid cleaner in a clear container. For another, the streaking and filming characteristics afforded when using the surfactants of Black have been found to be not nearly so good as what is indicated in those patents—at least not relative to what quality of surface appearance, has now been found might actually be obtained by use of the invention to be disclosed herein.

Disclosed in PCT International App. No. WO 98/02511 (published Jan. 22, 1998), also to Black, is essentially a further embodiment of the invention of U.S. Pat. Nos. 5,536,452 and 5,536,452. Here it is revealed that an anionic surfactant such as N-acyl-N,N'-ethylenediaminetriacetic acid may function as both the surfactant and the chelating agent for an acidic formula shower rinsing composition. Additionally, in the case where a separate surfactant and chelating agent are employed, the classes of suitable surfactants have been expanded. Now called out for the surfactant component are amine oxides, imidazoline derivatives, betaines, quaternary ammonium compounds, amphoteric surfactants, sulfonates and alkyl sulfates, ether carboxylates, sarcosines, iesethionates, phosphoterics and phosphate esters. The compositions of this application are preferably at a pH of 4–6.

Notably, the Black PCT application indicates that small quantities of "super wetting surfactants," such as a silicone glycol copolymer or pyrilidone, may also be added to prevent streaking on shower surfaces, which would suggest that the disclosed compositions are not entirely free from exhibiting undesired streaking.

Disclosed in Japanese Kokai Pat. App. No. Hei 10[1998]-08,090 (published Jan. 13, 1998) is a detergent composition for hard surfaces, in particular for the bathroom, containing a glycoside having the structure:

$$R^1O—(Z)_n$$

where $R^1$ represents a hydrocarbon group with an average number of carbon atoms of 8.0–9.5, Z represents a residue derived from a reducing sugar, and n is a number in the range of 1–2 and represents the average degree of polymerization of the residual group Z. Use of glycosides having these parameters are reported to give the best combination of detergency, foaming power and rinsing characteristics for the cleaner. It is preferred that the formula also contain a polyether sulfuric acid ester salt where additional detergency is required. Also preferred is the inclusion of a glycol ether and a chelant, such as the disodium salt of ethylenediaminetetraacetic acid (EDTA). The preferred pH for the composition is stated to be 6.0–8.0. There is no suggestion that the compositions might be formulated as a shower rinsing composition or that they might be used in that manner.

None of the prior art teaches, discloses or suggests the use of a glycoside as the surfactant portion in a shower rinsing composition with the surprising advantage of greatly improved streaking and filming performance as compared to other nonionic surfactants and wherein the best performing glycosides, surprisingly, exhibit an HLB value of greater than 13, and further wherein even alkaline shower rinsing compositions which contain a glycoside as surfactant are found to perform significantly better than acidic formulations containing other nonionic surfactants.

SUMMARY OF THE INVENTION

Briefly, the present invention is directed to an improved cleaning composition of the "shower rinsing" type for the cleaning of tub and shower surfaces without the need for scrubbing, wiping, or even immediate rinsing. The invention is based in part on the completely unexpected discovery that formulations of a shower rinsing composition which incorporate a glycoside as surfactant, especially an alkyl polyglycoside having an HLB of greater than 13—which high value HLB surfactants are explicitly contraindicated by the references of Black above, exhibit a remarkably improved surface appearance with respect to streaking and filming after their application as compared to compositions containing other nonionic surfactants and, further, exhibit a greatly improved bathroom soil and soap scum removing ability.

In one aspect, the invention is directed to a cleaning composition for shower and tub surfaces of the type which requires no scrubbing, wiping or immediate rinsing, comprising:

(a) a glycoside surfactant, the total amount of said surfactant being present in a cleaning effective amount;

(b) a chelating agent, said chelating agent present in an amount effective to enhance bathroom soil removal in said composition; and (c) the remainder, water, said cleaning composition characterized by the ability to clean said shower and tub surfaces without streaking or filming.

In another aspect, the invention is directed to a cleaning composition as just described which also contains at least one water-soluble or dispersible organic solvent having a vapor pressure of at least 0.001 mm Hg at 25° C., said at least one organic solvent present in a solubilizing- or dispersion-effective amount In a further aspect, the invention is directed to a cleaning composition as described above which also contains a quaternary ammonium surfactant or disinfectant.

In yet another aspect, the invention is directed to a method for cleaning shower and tub surfaces, comprising the steps of:

wetting surfaces of a shower;

applying to the wet shower surfaces after showering with a cleaning composition comprising:

(a) a glycoside surfactant, the total amount of said surfactant being present in a cleaning effective amount;

(b) a chelating agent, said chelating agent present in an amount effective to enhance bathroom soil removal in said composition; and (c) the remainder, water, whereby the shower surfaces are cleaned without the need for scrubbing, wiping, or immediate rinsing, and are free from streaking and filming.

It is therefore an object and an advantage of the present invention to provide a shower rinsing composition which contains as the surfactant portion a glycoside to greatly improve the streaking and filming performance of such a composition.

It is another object and another advantage of the present invention to provide a shower rinsing composition which contains a glycoside surfactant to greatly improve the bathroom soil removing ability of such a composition.

It is a further object and a further advantage of the present invention to provide a shower rinsing composition which contains a glycoside surfactant and which affords a clear solution at room temperature to permit a product comprising the same to be aesthetically packaged in a clear bottle.

It is yet another object and yet another advantage of the present invention to provide a shower rinsing composition which contains a glycoside surfactant and to which may be optionally added a quaternary ammonium surfactant or disinfectant while still obtaining satisfactory streaking and filming results.

It is still a further object and still a further advantage of the present invention to provide a shower rinsing composition which contains a glycoside surfactant and which exhibits superior streaking and filming performances whether in an alkaline or acidic formulation.

DETAILED DESCRIPTION OF THE INVENTION

The invention provides a formulation comprising an improved cleaning composition of the shower rinsing type especially adapted for the removal of bathroom soils from a hard surface without streaking or filming. Bathroom soils may include soap scum, mineral deposits, dirt, and various oily substances. The bathroom surface with which the invention will most typically be employed is a shower stall or bathtub, which may have glass doors, and includes vertical wall surfaces typically made of tile, glass, or composite materials.

The inventive cleaner is intended to clean shower and tub surfaces by preferably spraying the composition with a pump or pressurized spray dispenser (in either aerosol or non-aerosol fashion) onto the surface. It is preferable that the composition be applied to such surfaces while they are wet, that is, after showering or bathing. No scrubbing, wiping or even immediate rinsing is necessary, and the cleaner frees soils and deposits without streaking or filming. The removed materials then pass clown the drain with a subsequent use of the shower or tub. The shower rinsing composition is primarily intended to be used to maintain the bathroom surfaces in a clean state and is thus preferably used on a daily basis, or at least several times a week. That the user would need to use the cleaner several times a week by spray application after showering is seen as being much less effort than the amount of exertion that must be expended in scrubbing and wiping with a conventional bathroom cleaner on a less frequent basis. Moreover, the shower and tub surfaces remain in a clean state at all times creating a continuously more attractive and healthy bathroom environment. It should be noted that the inventive cleaner will also gradually remove accumulated bathroom soil after a number of applications and is thus not limited to being a "maintenance" type of cleaner.

The shower rinsing composition or cleaner is preferably a single phase, clear, isotropic solution, having a viscosity generally less than about 100 Centipoise ("cps"). The basic composition has the following ingredients:

(a) a glycoside surfactant, the total amount of said surfactant being present in a cleaning-effective amount;

(b) a chelating agent, said chelating agent present in an amount effective to enhance bathroom soil removal in said composition; and (c) the remainder, water.

At least one water-soluble or dispersible organic solvent having a vapor pressure of at least 0.001 mm Hg at 25° C. and present in a solubilizing- or dispersion-effective amount may be incorporated into the basic composition.

Additional adjuncts in small amounts such as buffers, fragrances, dyes, bleaching agents and the like can be included to provide desirable attributes of such adjuncts.

In the application, effective amounts are generally those amounts listed as the ranges or levels of ingredients in the descriptions which follow hereto. Unless otherwise stated, amounts listed in percentage ("%'s") are in weight percent (based on 100% active) of the cleaning composition.

1. Surfactants

The crux of the invention lies in the use of a glycoside as the major surfactant portion of the composition. Particularly preferred are the alkyl polyglycosides. The preferred glycosides include those of the formula:

$$RO(C_nH_{2n}O)_y(z)_x$$

wherein R is a hydrophobic group (e.g., alkyl, aryl, alkylaryl etc., including branched or unbranched, saturated and unsaturated, and hydroxylated or alkoxylated members of the foregoing, among other possibilities) containing from about 6 to about 30 carbon atoms, preferably from about 8 to about 16 carbon atoms, and more preferably from about 8 to about 12 carbon atoms; n is a number from 2 to about 4, preferably 2 (thereby giving corresponding units such as ethylene, propylene and butylene oxide); y is a number having an average value of from 0 to about 12, preferably 0; Z is a moiety derived from a reducing saccharide containing 5 or 6 carbon atoms (e.g., a glucose, fructose, mannose, galactose, talose, gulose, allose, altrose, idose, arabinose, xylose, lyxose, or ribose unit, etc., but most preferably a glucose unit); and x is a number having an average value of from 1 to about 10, preferably from 1 to about 5, and more preferably from 1 to about 3. In actual practice, R may be a mixture of carbon chains, for instance, from 8 to 16 carbon atoms and Z may be a mixture of saccharide units from 0 to 6.

It would be apparent that a number of variations with respect to the makeup of the glycosides are possible. For example, mixtures of saccharide moieties (Z) may be incorporated into polyglycosides. Also, the hydrophobic group (R) can be attached at the 2-, 3-, or 4-positions of a saccharide moiety rather than at the 1-position (thus giving, for example, a glucosyl as opposed to a glucoside). In addition, normally free hydroxyl groups of the saccharide moiety may be alkoxylated or polyalkoxylated. Further, the $(C_nH_{2n}O)_y$ group may include ethylene oxide and propylene oxide in random or block combinations, among a number of other possible variations.

The preferred alkyl polyglycosides have an HLB value of greater than 13.0, and more preferably 13.5 or greater. This is in direct contradiction to the previously mentioned Black patents, which teach that only nonionic surfactants having an HLB of 13.0 or less yield satisfactory results with respect to streaking and filming in a shower rinsing composition. These high HLB value alkyl polyglycoside surfactants exhibit a greatly superior surface performance compared to other nonionic surfactants. Further, even those alkyl polyglycosides having lower HLB values (i.e., within the range taught by Black) exhibit surprisingly superior surface appearance performance compared to the nonionic surfactants of Black. Still further, alkyl polyglycosides exhibit surprisingly superior surface performance and cleaning performance versus other nonionics whether the alkyl polyglycoside is part of an acidic formulation or an alkaline formulation. All of the foregoing will be comparatively demonstrated in the Experimental section which follows later below.

Non-limiting examples of glycoside surfactants include Glucopon 225 (a mixture of $C_8$ and $C_{10}$ chains equivalent to an average of $C_{9\ 1}$, with x of the general formula above of 1.7, and an HLB of 13.6; Glucopon 220 (a mixture of $C_8$ and $C_{10}$ chains equivalent to an average of $C_{9.1}$, with x of the general formula above of 1.5, and an HLB of 13.5; Glucopon 425 (a mixture of $C_8$, $C_{10}$, $C_{12}$, $C_{14}$, and $C_{16}$ chains equivalent to an average of $C_{10.3}$, with x of the general formula above of 1.45, and an HLB of 13.1; Glucopon 625 (a mixture of $C_{12}$, $C_{14}$, and $C_{16}$ chains equivalent to an average of $C_{12.8}$, with x of the general formula above of 1.60, and an HLB of 12.1; and Glucopon 600 (a mixture of $C_{12}$, $C_{14}$, and $C_{16}$ chains equivalent to an average of $C_{12.8}$ with x of the general formula above of 1.40, and an HLB of 11.5, all manufactured by the Henkel Corporation. Of these, Glucopon 425 is preferred, and Glucopon 225 and Glucopon 220 are more preferred. Glucosides from other manufacturers, such as Triton CG-110, having an HLB of 13.6 and manufactured by Union Carbide also may serve as examples of suitable surfactants.

Glucoside surfactants are frequently supplied as mixtures with other surfactants. For example, mixtures with the anionic surfactants, lauryl sulfate or laurylether sulfate, or the amphoteric surfactants, cocamidopropylbetaine or cocamidopropyl amineoxide, are available from the Henkel Corporation.

The amounts of surfactants present are to be somewhat minimized, for purposes of cost-savings and to generally restrict the dissolved actives which could contribute to leaving behind residues when the composition is applied to a surface. However, the amounts added are generally about 0.001–15%, more preferably 0.002–4.00% surfactant. These are generally considered to be cleaning-effective amounts.

a. Cosurfactants

Although the disclosed glycosides of the invention provide excellent cleaning performance, as shown in the examples which follow, it may sometimes be desired to add cosurfactants to the formulations to obtain additional cleaning benefits. The glycoside surfactant may be used in conjunction with any of the other nonionic, anionic, cationic or amphoteric surfactants, or mixtures thereof, such as are known in the art. Such surfactants are described, for example, in *McCutcheon's Emulsifiers and Detergents* (1997), the contents of which are hereby incorporated by reference.

Illustrative nonionic surfactants are the ethylene oxide and mixed ethylene oxide/propylene oxide adducts of alkylphenols, the ethylene oxide and mixed ethylene oxide/propylene oxide adducts of long chain alcohols or of fatty acids, mixed ethylene oxide/propylene oxide block copolymers, esters of fatty acids and hydrophilic alcohols, such as sorbitan monooleate, alkanolamides, and the like.

Illustrative anionic surfactants are the soaps, alkylbenzene sulfonates, olefin sulfonates, parafin sulfonates, alcohol and alcoholether sulfates, phosphate esters, and the like.

Illustrative cationic surfactants include amines, amine oxides, alkylamine ethoxylates, ethylenediamine alkoxylates such as the Tetronic® series from BASF, quaternary ammonium salts, and the like.

Illustrative amphoteric surfactants are those which have both acidic and basic groups in their structure, such as amino and carboxyl radicals or amino and sulfonic radicals, or amine oxides and the like. Suitable amphoteric surfactants include betaines, sulfobetaines, imidazolines, and the like.

The amounts of cosurfactants will generally be about the level of the primary surfactant glycoside, or less.

2. Chelating Agent

The chelating agent is also an important part of the invention. Chelants useful herein include the various alkali metal, ammonium and substituted ammonium polyacetates, carboxylates, polycarboxylates and polyhydroxysulfonates. Non-limiting examples of polyacetate and polycarboxylate builders include the sodium, potassium, lithium, ammonium and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These chelating agents may also exist either partially or totally in the hydrogen ion form, for example, citric acid or disodium dihydrogen ethylenediamine tetraacetate. The substituted ammonium salts include those from methylamine, dimethylamine, butylamine, butylenediamine, propylamine, triethylamine, trimethylamine, monoethanolamine, diethanolamine, triethanolamine, isopropanolamine, and propanolamine.

The preferred chelating agents, and dependent on the desired pH of the formulation (see below), are the mono-, di-, tri-, and tetrapotassium and ammonium salts of ethylenediamine tetraacetic acid. For example, at a pH of 12, tetrapotassium ethylenediamine tetraacetate (tetrapotassium EDTA) is the more preferred chelant, while at a pH of 4–5, diammonium EDTA or disodium EDTA, is more preferred. At a pH of 2, citric acid is a preferred chelant.

The amount of chelant added should be in the range of 0.01–10%, more preferably 0.1–2%, by weight of the cleaner.

3. Water (pH)

Since the cleaner is an aqueous cleaner with relatively low levels of actives, the principal ingredient is water, which should be present at a level of at least about 60%, more preferably at least about 70%, and most preferably, at least about 80%.

Distilled, deionized, or industrial soft water is preferred so as not to contribute to formation of a residue and to avoid the introduction of undesirable metal ions.

The use of a glycoside surfactant, regardless of pH, gives surprisingly superior performance compared to other nonionic surfactants. Thus, the inventive shower rinsing cleaners may be formulated as either acidic or alkaline solutions. In hard water areas, it may be more desirable that the cleaner be formulated at a lower pH for removal of hard water deposits. On the other hand, formulations of a higher pH may be more effective with respect to soap scum removal. Thus, a first preferred pH is about 5, while a second preferred pH is about 12.

4. Solvents

A solvent may optionally be used which is generally a water soluble or dispersible organic solvent having a vapor pressure of at least 0.001 mm Hg at 25° C. It is preferably selected from $C_{1-6}$ alkanols, $C_{1-6}$ diols, $C_{1-6}$ alkyl ethers of alkylene glycols and polyalkylene glycols, and mixtures thereof. The alkanol can be selected from methanol, ethanol, n-propanol, isopropanol, the various positional isomers of butanol, pentanol, and hexanol, and mixtures of the foregoing. It may also be possible to utilize in addition to, or in place of, said alkanols, the diols such as methylene, ethylene, propylene and butylene glycols, and mixtures thereof, and including polyalkylene glycols.

It is preferred to use a straight or branched chain alkanol as the coupling agent of the invention. These are methanol, ethanol, n-propanol, isopropanol, and the various positional isomers of butanol, pentanol, and hexanol. Especially preferred is isopropyl alcohol ("IPA"), also known as 2-propanol and, in the vernacular, "isopropanol."

One can also use an alkylene glycol ether solvent in this invention. The alkylene glycol ether solvents can be used alone or in addition to the polar alkanol solvent. These can include, for example, monoalkylene glycol ethers such as ethylene glycol monopropyl ether, ethylene glycol mono-n-butyl ether, propylene glycol monopropyl ether, and propylene glycol mono-n-butyl ether, and polyalkylene glycol ethers such as diethylene glycol monoethyl or monopropyl or monobutyl ether, di- or tri-polypropylene glycol monomethyl or monoethyl or monopropyl or monobutyl ether, etc., and mixtures thereof. Additionally, acetate and propionate esters of glycol ethers can be used. Preferred glycol ethers are diethylene glycol monobutyl ether, also known as 2-(2-butoxyethoxy) ethanol, sold as Butyl Carbitol by Union Carbide, ethylene glycol monobutyl ether, also known as butoxyethanol, sold as Butyl Cellosolve also by Union Carbide, and also sold by Dow Chemical Co., and propylene glycol monopropyl ether, available from a variety of sources. Another preferred alkylene glycol ether is propylene glycol t-butyl ether, which is commercially sold as Arcosolve PTB, by Arco Chemical Co. Dipropylene glycol n-butyl ether ("DPNB") is also preferred.

Additional water insoluble solvents may be included in minor amounts (0–2%). These include isoparafinic hydrocarbons, mineral spririts, alkylaromatics, and terpenes such as d-limonene. Additional water soluble solvents may be included in minor amounts (0–5%). These include pyrrolidones, such as N-methyl-2-pyrrolidone, N-octyl-2-pyrrolidone and N-dodecyl-2-pyrrolidone.

It is preferred to limit the total amount of solvent to preferably no more than about 20%, and more preferably, no more than about 10%, of the cleaner. A particularly preferred range is about 1-5%. These amounts of solvents are generally referred to as dispersion-effective or solubilizing-effective amounts. The solvents, especially the glycol ethers, are also important as cleaning materials on their own, helping to loosen and solubilize greasy or oily soils from surfaces cleaned.

5. Biocides

Among cationic surfactants, but without limitation thereto, are the quaternary ammonium compounds and salts thereof. Such compounds, sometimes referred to as "quats," are often capable of imparting a broad spectrum antimicrobial or germicidal effect to a cleaning composition. Generally these compounds will have at least one higher molecular weight group and two or three lower molecular weight groups linked to a common, positively charged nitrogen atom. An electrically balancing anion will typically be a halide, acetate, nitrite or lower alkosulfate. The anions may include, for example, bromide, methosulfate, or, most commonly, chloride. The higher molecular weight or hydrophobic substituent(s) on the nitrogen will often be a higher alkyl group, containing from about 6–30 carbon atoms. The remaining lower molecular weight substituents will generally contain no more than a total of 12 carbon atoms and may be, for example, lower alkyls of 1 to 4 carbon atoms, such as methyl and ethyl, which may be substituted, e.g., with hydroxy. One or more of any of the substituents may include or may be replaced by an aryl moiety such as benzyl, ethylbenzyl, or phenyl. Many variations of such cationic surfactants are possible, as will be apparent to those skilled in the art.

Exemplary classes of quaternary ammonium salts include the alkyl ammonium halides such as lauryl trimethyl ammonium chloride and dilauryl dimethyl ammonium chloride, and alkyl aryl ammonium halides such as octadecyl dimethyl benzyl ammonium bromide, and the like. Preferred materials with specific sources include didecyl dimethyl ammonium chloride, available as BTC 1010 from Stepan Chemical Co., as BARDAC® 2250 from Lonza, Inc., as FMB 210-15 from Huntington, and as Maquat 4450-E from Mason; dialkyl dimethyl ammonium chloride, available as BTC 818, BARDAC® 2050, Inc., FMB 302, and Maquat 40, each from the source as previously correlated; and alkyl dimethyl benzyl ammonium chloride, available as BTC 835, BARQUAT® MB-50 (from Lonza, Inc.), FMB 451-5, and MC 1412 (from Mason).

Such quaternary germicides are often sold as mixtures of two or more different quaternaries. Non-limiting examples of such suitable preferred mixtures include the twin chain blend/alkyl benzyl ammonium chloride compounds available as BARDAC®205M and BARDAC®208M from Lonza, Inc., as BTC 885 and BTC 888 from Stepan Chemical Co., as FMB 504 and FMB 504-8 from Huntington, and as MQ 615M and MQ 624M from Mason.

Other biocides may also be present in the invention. Illustrative of these other biocides are phenolics, such as o-phenylphenol, 4-chloro-2-cyclopentylphenol, o-benzyl-p-chlorophenol, and the like; and carbanilides, such as 3,4,4'-trichloro-carbanilide.

Typical amounts of the biocide compounds and mixtures of biocide compounds range from preferably about 0–5%, more preferably about 0.001–1% .

6. Miscellaneous Adjuncts

Buffering and pH adjusting agents may be desireable components. These would include inorganic agents such as alkali metal and alkaline earth salts of silicate, metasilicate, borate, carbonate, carbamate, phosphate, ammonia, and hydroxide. Organic buffering agents such as monoethanolamine, monopropanolamine, diethanolamine, dipropanolamine, triethanolamine, and 2-amino-2-methylpropanol are also desireable.

Small amounts of adjuncts can be added for improving aesthetic qualities of the invention. Aesthetic adjuncts include fragrances or perfumes, such as those available from Givaudan-Rohre, International Flavors and Fragrances, Quest, Sozio, Firmenich, Dragoco, Norda, Bush Boake and Allen and others, and dyes or colorants which can be solubilized or suspended in the formulation. The amounts of these aesthetic adjuncts should be in the range of 0–2%, more preferably 0–1%.

Other various adjuncts which are known in the art for detergent compositions can be added so long as they are not used at levels that cause unacceptable spotting/filming. Nonlimiting examples of such adjuncts are: enzymes such as lipases and proteases, hydrotopes such as xylene sufonates and toluene sulfonates, and bleaching agents such as peracids, hypohalite sources, hydrogen peroxide and sources of hydrogen peroxide.

Additionally, because the surfactants in liquid systems are sometimes subject to attack from microorganisms, it is advantageous to add a mildewstat or bacteriostat. Exemplary mildewstats (including non-isothiazolone compounds) include Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-ritropropane 1,3-diol, from Boots Company Ltd.; Proxel CRL, a propyl-p-hydroxybenzoate, from ICI PLC; Nipasol M, an o-phenylphenol, $Na^+$ salt, from Nipa Laboratories Ltd.; Dowicide A, a 1,2-benzoisothiazolin-3-one, from Dow Chemical Co.; and Irgasan DP 200, a 2,4,4'-trichloro-2-hydroxydiphenylether, from Ciba-Geigy A.G. See also, Lewis et al., U.S. Pat. No. 4,252,694 and U.S. Pat. No. 4,105,431, incorporated herein by reference.

EXPERIMENTAL

In the following experiments, a number of conventional nonionic surfactants and alkyl polyglycoside surfactants were each incorporated as part of otherwise identical shower rinsing compositions of both pH 5 and pH 12 (i.e., two separate formulations were made up for each surfactant) and all such compositions were compared with respect to their surface appearance and cleaning performances as described and shown below.

| The pH 5 formulas consist of the following: | |
|---|---|
| Nonionic surfactant | 2% |
| Isopropyl alcohol | 2.2% |
| Diammonium EDTA[1] | 1% |
| Fragrance | 0.02% |
| Quat. ammonium cmpd. | 0.2%[2] or |
| (optional) | 0.1%[3] |
| Water | (balance) |
| **The pH 12 formulas consist of the following:** | |
| Nonionic surfactant | 2% |
| Isopropyl alcohol | 2.2% |
| Tetrapotassium EDTA[4] | 1% |
| Fragrance | 0.02% |
| Water | (balance) |

[1]Sequestrene 40 (45%-Ciba)
[2]Barquat 4250Z (50%-Lonza) (mixture of alkyl benzyldimethylammonium chloride and alkyl ethylbenzyldimethylammonium chloride)
[3]BTC 885 (50%-Stepan) (a mixture of alkyl benzyldimethylammonium chloride and dialkyl dimethylammonium chloride)
[4]Hamp-ene K4 (45%-AKZO Nobel)

EXAMPLE 1

Stress Test

Each of the pH 5 and pH 12 formulations were compared for surface appearance performance under what is denoted herein as a "stress test." The stress test consists of spraying black ceramic tiles with 2 sprays of the formulation solution and waiting ten minutes. The spraying is repeated a total of ten times and the tiles are allowed to dry. The tiles are graded on a scale of 1 to 10, with 1 equal to no apparent filming or streaking and 10 equal to heavy filming and streaking. Thus, the lower the grade, the better. The results are depicted in Table I:

TABLE I

| Nonionic surfactant | HLB | Surface Appearance pH 5 | Surface Appearance pH 12 | Appearance with Barquat 4250Z pH 5 | Appearance with Barquat 4250Z pH 12 | Appearance with BTC 885 pH 5 | Appearance with BTC 885 pH 12 |
|---|---|---|---|---|---|---|---|
| Antarox BL-225[1] | 12 | 9 | 9 | 9 | 10 | 9 | 9 |
| Neodol 25-12[2] | 14.4 | 9 | 9 | 10 | 9 | 10 | 9 |
| Glucopon 225[3] | 13.6 | 1 | 3 | 1 | 4 | 1 | 4 |
| Glucopon 425[3] | 13.1 | 1 | 2 | 3 | 4 | 1 | 2 |
| Glucopon 625[3] | 12.1 | 6 | 5 | 5 | 5 | 5 | 4 |
| Glucopon 600[3] | 11.5 | 7 | 6 | 4 | 7 | 5 | 5 |

[1]Linear aliphatic mixed glycol ether (Rhone-Poulenc) — the preferred surfactant of Black, U.S. Pat. Nos. 5,536,452 & 5,587,022
[2]Aliphatic glycol ether (Shell Chemical)
[3]Alkyl polyglycoside (50% — Henkel) (see text for characterization)

As is apparent, the shower rinsing compositions with the glycoside surfactants—especially those alkyl polyglycosides having HLB values above 13.0—dramatically outperform the conventional nonionic surfactants with respect to streaking and filming, whether at low or high pH, with the addition of a quaternary ammonium compound causing no significant deterioration in performance. That the higher HLB glycosides should perform so well is directly contrary to the teachings of the prior art. Further, because the alkyl polyglycoside surfactants exhibit a very high cloud point (>100° C.), compositions which employ the same are clear at room temperature (and temperatures well above) and therefore allow presentation of a product to the consumer in a clear container.

EXAMPLE 2

Use Test

Each of the pH 5 and pH 12 formulations were compared for surface appearance performance under what is denoted herein as a "use test." The use test consists of spraying black ceramic tiles with 3 sprays of hard water (250 ppm hardness, 2:1 Ca to Mg, expressed as ppm Ca) followed by 2 sprays of the formulation solution and waiting ten minutes. The spraying is repeated a total of ten times and the tiles are allowed to dry. The tiles are graded on a scale of 1 to 10, with 1 equal to no apparent filming or streaking and 10 equal to heavy filming and streaking. Thus, the lower the grade, the better. The results are depicted in Table II:

TABLE II

| Nonionic surfactant | HLB | Surface Appearance pH 5 | Surface Appearance pH 12 | Appearance with Barquat 4250Z pH 5 | Appearance with Barquat 4250Z pH 12 | Appearance with BTC 885 pH 5 | Appearance with BTC 885 pH 12 |
|---|---|---|---|---|---|---|---|
| Antarox BL-225 | 12 | 9 | 9 | 9 | 10 | 9 | 9 |
| Neodol 25-12 | 14.4 | 9 | 9 | 10 | 9 | 10 | 9 |
| Glucopon 225 | 13.6 | 1 | 3 | 1 | 4 | 1 | 4 |
| Glucopon 425 | 13.1 | 2 | 2 | 1 | 5 | 1 | 2 |

TABLE II-continued

| Nonionic surfactant | HLB | Surface Appearance pH 5 | Surface Appearance pH 12 | Appearance with Barquat 4250Z pH 5 | Appearance with Barquat 4250Z pH 12 | Appearance with BTC 885 pH 5 | Appearance with BTC 885 pH 12 |
|---|---|---|---|---|---|---|---|
| Glucopon 625 | 12.1 | 7 | 4 | 7 | 6 | 6 | 5 |
| Glucopon 600 | 11.5 | 7 | 6 | 7 | 7 | 7 | 7 |

[1]Linear aliphatic mixed glycol ether (Rhone-Poulenc) — the preferred surfactant of Black, U.S. Pat. Nos. 5,536,452 & 5,587,022
[2]Aliphatic glycol ether (Shell Chemical)
[3]Alkyl polyglycoside (50% — Henkel) (see text for characterization)

Again, it is apparent that the shower rinsing compositions with the higher HLB value glycoside surfactants dramatically outperform the conventional nonionic surfactants in surprising contradiction to the teachings of the prior art.

EXAMPLE 3

Stress Test with Other Constituents

That the invention can be successfully practiced with other surfactants, solvents, and chelating agents is shown below in Table III (with Glucopon 225 as the glycoside surfactant). That the present invention can also be successfully practiced with amines, silanes, silicon surfactants, fluoro-surfactants and in the absence of solvent is shown below in Table IV (with Glucopon 220 as the glycoside surfactant). In both Tables, the indicated formulations were subjected to the stress test conditions of Example 1 (above). The tiles were graded on a scale of 1 to 10, with 1 equal to no apparent filming or streaking and 10 equal to heavy filming and streaking, as before.

TABLE III

| | A | B | C | D | E | F | G |
|---|---|---|---|---|---|---|---|
| Glucopon 225 | 2% | 2% | 2% | 2% | 2% | 2% | 2% |
| Isopropyl alcohol | 2% | 2% | 2% | 2% | | | 2% |
| Ethyleneglycolhexyl ether[1] | | | | | 2% | | |
| Dipropyleneglycolpropyl ether[2] | | | | | | 2% | |
| Diammonium EDTA | | | | | 1% | 1% | |
| Disodium EDTA[3] | | | | | | | 1% |
| Citric acid[4] | 1% | | | | | | |
| Sodium polyacrylate[5] | | 1% | | | | | |
| Sodium lauryl sulfate[6] | | | 0.5% | | | | |
| Antarox BL-225 | | | | 0.5% | | | |
| Appearance | 1 | 4 | 2 | 3 | 2 | 2 | 2 |

[1]Dowanol EB (Dow Chemical)
[2]Dowanol DPNP (Dow Chemical)
[3]Dissolvine NA-2 (AKZO Chemicals)
[4]Citrosol 503 (50%-Archer Daniels Midland)
[5]Acusol 479N (Rohm & Haas)
[6]Stepanol WAC (30%-Stepan)

TABLE IV

| | A | B | C | D | E | F | G |
|---|---|---|---|---|---|---|---|
| Glucopon 220 | 1% | 1% | 1% | 1% | 1% | 1% | 1% |
| Isopropyl alcohol | 4% | 4% | 4% | 4% | 4% | 4% | |
| Tetrapotassium EDTA | 0.5% | 0.5% | 0.5% | 0.5% | 0.5% | | |
| Diammonium EDTA | | | | | | 4% | 1% |
| 2-Amino-2-methylpropanol[1] | 0.5% | | | | | | |
| Triethanolamine[2] | | 0.5% | | | | | |
| Fluorosurfactant[3] | | | 0.05% | | | | |

TABLE IV-continued

| | A | B | C | D | E | F | G |
|---|---|---|---|---|---|---|---|
| Dimethicone copolyol[4] | | | | 0.05% | | | |
| Hydrolyzed alkoxysilane[5] | | | | | 0.1% | | |
| Appearance | 1 | 1 | 1 | 1 | 5 | 1 | 4 |

[1]AMP-95 (Angus)
[2](Huntsman)
[3]Fluorad FC-170-C (50%-3M)
[4]Silwet L-77 (Union Carbide)
[5]TLF 8291 (10%-Dupont)

Thus, the use of glycoside surfactants allows for great versatility in formulation, while consistently providing better surface appearance results than conventional nonionic surfactants.

In the next set of experiments, the actual cleaning performance with respect to bathroom soil and soap scum of inventive shower rinsing compositions at pH 5 and pH 12 were compared against a commercial shower rinsing formulation (pH 5) and a composition containing a conventional nonionic surfactant (pH 12) but otherwise identical to the pH 12 inventive composition. Table V discloses these formulas, in which Formula A is the commercial product CLEAN SHOWER®, Formula B is the pH 12 conventional surfactant-containing composition, and Formulas C and D are the inventive compositions formulated to pH 5 and pH 12, respectively:

TABLE V

| | Formula A[1] | Formula B | Formula C | Formula D |
|---|---|---|---|---|
| Antarox BL-225 | X% | | | |
| Tergitol Min IX[2] | | 2% | | |
| Glucopon 220 | | | 2% | 2% |
| Isopropanol | X% | 2.2% | 2.2% | 2.2% |
| Tetrapotassium EDTA | | 1% | | 1% |
| Diammonium EDTA | X% | | 1% | |
| Fragrance | X% | 0.02% | 0.02% | 0.02% |

[1]CLEAN SHOWER ® (Automation Inc., U.S. Pat. Nos. 5,536,452 & 5,587,022)
[2]Nonionic mixture of alkyl ethylene and propylene glycol ethers (Union Carbide)

EXAMPLE 4

Bathroom Soil and Soap Scum Removal (Performance Test)

The formulations of Table V were tested on synthetic bathroom soil and soap scum (for purposes of this example, the term "soap scum" refers to a "purer" form of bathroom soil containing only the calcium salt of a fatty acid).

| The bathroom soil consists of the following: | |
|---|---|
| Sodium stearate | 13% |
| Water | 84% |
| Carbon black | 0.1% |
| Synthetic sebum | 1.5% |
| Ca, Mg & Fe stearates | 1% |
| Dirt | 0.5% |

-continued

| The soap scum consists of the following: | |
|---|---|
| Ethanol | 84.7% |
| Calcium stearate | 5% |
| Water | 10% |
| Acramin blue | 0.3% |

The above soils were sprayed onto white ceramic tiles and dried. The performance test then consists of 3 sprays of hard water (250 ppm hardness, 2:1 Ca to Mg, expressed as ppm Ca) followed by 2 sprays of the formulation to be tested and waiting for ten minutes. The spraying is repeated a total of 15 times for bathroom soil and 25 times for soap scum and the tiles are allowed to dry. The tiles are graded on a scale of 1 to 10, with 1 equal to complete soil removal and 10 equal to no apparent soil removal. Thus, the lower the grade, the better. The results are depicted in Table VI:

TABLE VI

| | Bathroom Soil | Soap Scum |
|---|---|---|
| Formula A = CLEAN SHOWER ® (Nonionic, pH 5) | 10 | 9 |
| Formula B (Nonionic, pH 12) | 7 | 7 |
| Formula C (APG, pH 5) | 6 | 5 |
| Formula D (APG, pH 12) | 1 | 1 |

Thus, for a given pH, the shower rinsing compositions with the glycoside surfactants dramatically outperform the compositions containing conventional nonionic surfactants with respect to bathroom soil and soap scum removal. It is seen, then, that use of a glycoside surfactant remarkably improves all aspects of the desired cleaning characteristics of a bathroom cleaner of the shower rinsing type.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method for cleaning shower and tub surfaces, comprising the steps of:

wetting surfaces of a shower;

applying to the wet shower surfaces after showering with a non-aerosol cleaning composition consisting essentially of:

(a) a glycoside surfactant with, optionally, a surfactant selected from the group consisting of nonionic, anionic, cationic, amphoteric surfactant, and mixtures thereof, the total amount of said surfactants being from about 0.001–15 wt. %.

(b) about 0.01–10 wt. % a chelating agent selected from the group consisting of tetrapotassium ethylenediamine tetraacetic acid, diammonium ethylenediamine tetraacetic acid, and disodium ethylenediamine tetraacetic acid;

(c) about 1–20 wt. % of at least one water-soluble or dispersible organic solvent selected from the group consisting of alkanols, diols, polyalkylene glycols, alkyl ether of alkylene glycols and polyalkylene glycols, and mixtures thereof having a vapor pressure of at least 0.001 mm Hg at 25° Celsius; and (d) at least about 60 wt. % water, said cleaning composition is a single phase and characterized by the ability to clean said shower and tub surfaces without streaking or filming when not scrubbed, wiped or immediately rinsed and wherein said cleaning composition has a pH of from 4 to about 12.

2. The method of claim 1 wherein said glycoside surfactant is an alkyl polyglycoside.

3. The method of claim 1 wherein said alkyl polyglycoside has an HLB of greater than 13.

4. The method of claim 16 wherein said composition further consists essentially of a quaternary ammonium compound.

* * * * *